United States Patent [19]

Crawford

[11] Patent Number: 4,970,740

[45] Date of Patent: Nov. 20, 1990

[54] BI-MOTIONAL CRADLE

[76] Inventor: Joseph Crawford, 3399 Pamlico Dr., S.W., Atlanta, Ga. 30311

[21] Appl. No.: 522,804

[22] Filed: May 14, 1990

[51] Int. Cl.[5] ..... A47D 9/02

[52] U.S. Cl. ..... 5/109; 5/103; 5/105

[58] Field of Search ..... 5/101, 103, 105, 108, 5/109

[56] References Cited

U.S. PATENT DOCUMENTS

| | | | |
|---|---|---|---|
| 1,795,246 | 3/1931 | Brown . | |
| 1,803,887 | 5/1931 | Barnes . | |
| 2,544,298 | 3/1951 | Chodacki et al. | 5/109 |
| 2,552,223 | 5/1951 | Seifts . | |
| 2,566,983 | 9/1951 | Coltrane . | |
| 2,570,676 | 10/1951 | Henderson | 5/109 X |
| 2,805,427 | 9/1957 | Edgmon | 5/109 |
| 2,961,666 | 11/1960 | Finger | 5/109 |
| 3,139,630 | 7/1964 | Hunt . | |
| 3,656,195 | 4/1972 | Leahey | 5/109 |
| 3,724,006 | 4/1973 | Malabanan et al. | 5/109 |
| 3,886,608 | 6/1975 | Casella | 5/109 |
| 4,258,446 | 3/1981 | McAllister et al. | 5/109 |
| 4,752,980 | 6/1988 | Nafte | 5/109 |
| 4,775,184 | 10/1988 | Larkin | 297/260 |

*Primary Examiner*—Michael F. Trettel
*Attorney, Agent, or Firm*—Michael V. Drew

[57] ABSTRACT

A bi-motional cradle has a base with rollers affixed along each of two sides. A motor mounted on the base drives a crank arm which imparts to and fro translational motion to a cradle frame which rests upon the rollers of the base. A mediate frame member which lies within the cradle frame supports a second motor. The second motor has a crank arm rotably attached thereto. A cradle is suspended from the cradle frame by means which allow the cradle to hang freely and oscillate. The second motor's crank arm engages the cradle during a part of that crank arm's rotational motion. As the second motor's crank arm engages the cradle, it imparts a motion to the cradle that causes the cradle to swing, or oscillate. A baby lying in the cradle is soothed by a gentle, steady, two-directional motion.

4 Claims, 3 Drawing Sheets

BI-MOTIONAL CRADLE

FIELD OF THE INVENTION

The invention relates to cradles and, more particularly, to motorized cradles.

BACKGROUND OF THE INVENTION

A baby lying in a cradle is soothed if the cradle is rocked. Devices have been created which impart either a rocking, jogging, or translational motion to a baby cradle to bring about a soothing effect.

SUMMARY OF THE INVENTION

It is an object of the present invention to provide a motorized cradle that produces two types of oscillatory motion to soothe a baby.

According to a broad aspect of the invention, a base has rollers affixed along each of two sides. A first motor is mounted on the base. The motor has a crank arm which is rotably driven by the motor. A cradle frame rests upon the base. The frame has a bottom-most portion and a top-most portion. The cradle frame has parallel rods attached as a part of its lower-most portion that ride or glide upon the rollers of the base. The cradle frame is supported upon the rods. A connecting arm connects the crank arm to the frame. The connecting arm has one end pivotally connected to the cradle frame and has its other end pivotally connected to the free end of the crank arm. As the crank arm rotates, it imparts a motion to the connecting arm which in turn imparts translational motion to the cradle frame. This causes the cradle frame to translate to and fro upon the rollers as the crank arm turns. A mediate frame member lies within the cradle frame and supports a second motor. The second motor also has a crank arm rotably attached thereto. A cradle is suspended from the top-most portion of the cradle frame by means which allow the cradle to hang freely and oscillate. The second motor's crank arm and the cradle are aligned such that the free end of the crank arm engages the cradle during a part of the crank arm's rotational motion. As the second motor's crank arm engages the cradle, it imparts a motion to the cradle that causes the cradle to swing or oscillate. A baby lying in the cradle is soothed by a gentle, steady, two-directional motion.

Other aspects, objects, features, and advantages of the present invention will become apparent to those skilled in the art upon reading the detailed description of preferred embodiments in conjunction with the accompanying drawings and appended claims.

DETAILED DESCRIPTION OF PREFERRED EMBODIMENTS OF THE INVENTION

While the specification concludes with claims particularly pointing out and distinctly claiming the subject matter which is regarded as the present invention, the invention will now be described with reference to the following description of an embodiment taken in conjunction with the accompanying drawings.

Figure 1:
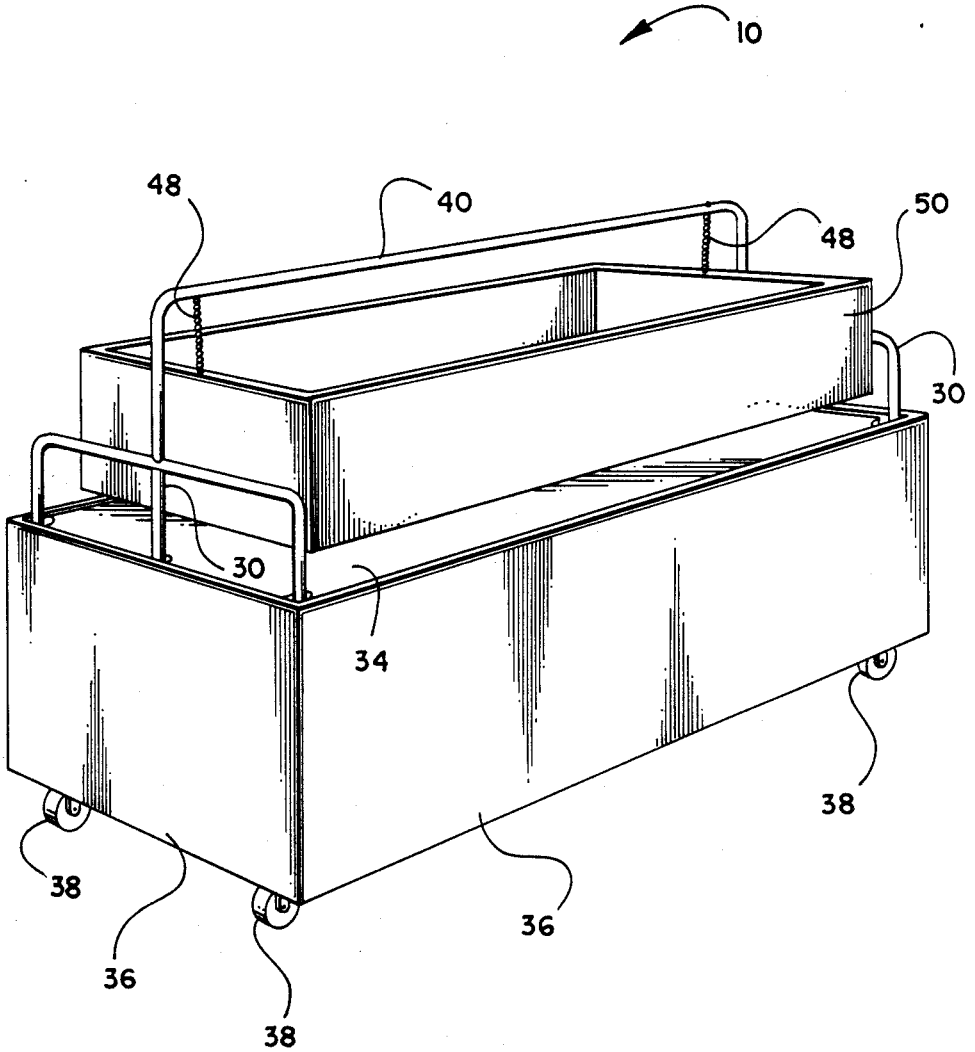
FIG. 1 is an isometric view of a cradle embodying the teachings of the present invention.
Figure 2:
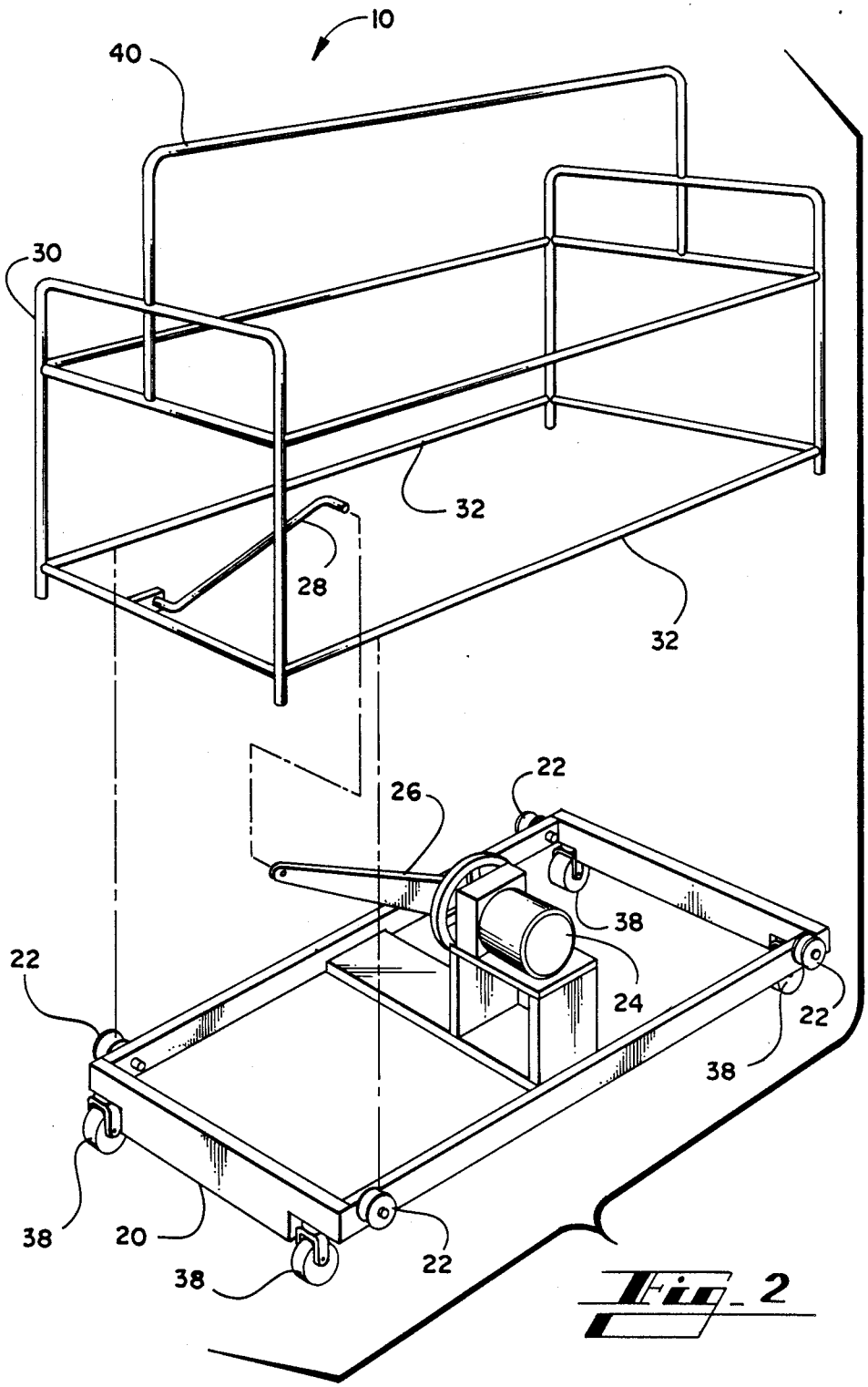
FIG. 2 is an isometric view of the cradle of FIG. 1 with the frame covering and other portions removed.

Throughout the drawings, the same reference numerals are used to denote like features. A cradle according to a preferred embodiment of the invention is shown in FIG. 1. In FIG. 1, many of the features of the cradle 10 are concealed by frame covers 36 which aesthetically enchance the cradle 10. Referring now also to FIG. 2, a support base 20 provides the foundation for the cradle 10. Rollers 22 are mounted along each of two parallel sides of the base 20. A first motor 24 is mounted upon the base. A cradle frame 30 rests upon the base. A rod 32 is disposed along either of two sides of the bottom-most portion of the cradle frame 30. Each rod 32 rests upon the rollers 22 along each side of the support base 20. The first motor 24 imparts a translational motion to the cradle frame 30. The first motor 24 has a crank arm 26 which is rotably attached to the motor 24. The free rotating end of the crank arm 26 is pivotally connected to one end of a connecting arm 28. The other end of the connecting arm 28 is pivotally connected to the frame. As the crank arm 26 rotates, it imparts motion to the connecting arm 28. The connecting arm 28 in turn imparts translational motion to the cradle frame 30. Thus, when the crank arm 26 rotates, the cradle frame is moved in to and from translational motion. The cradle frame 30 translates because the rods 32 freely glide over the rollers 22.

Figure 4:
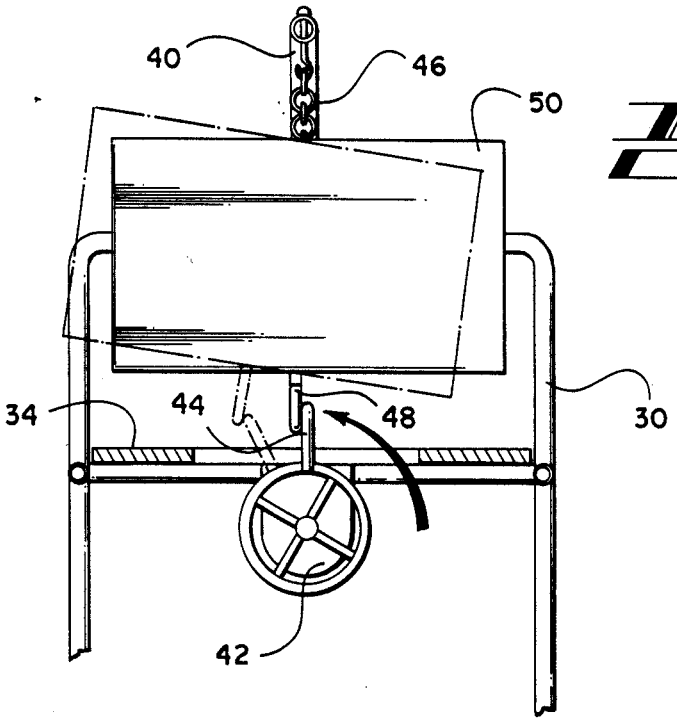
FIG. 4 is a sectional view of the upper portion of the cradle of FIG. 1.
Figure 3:
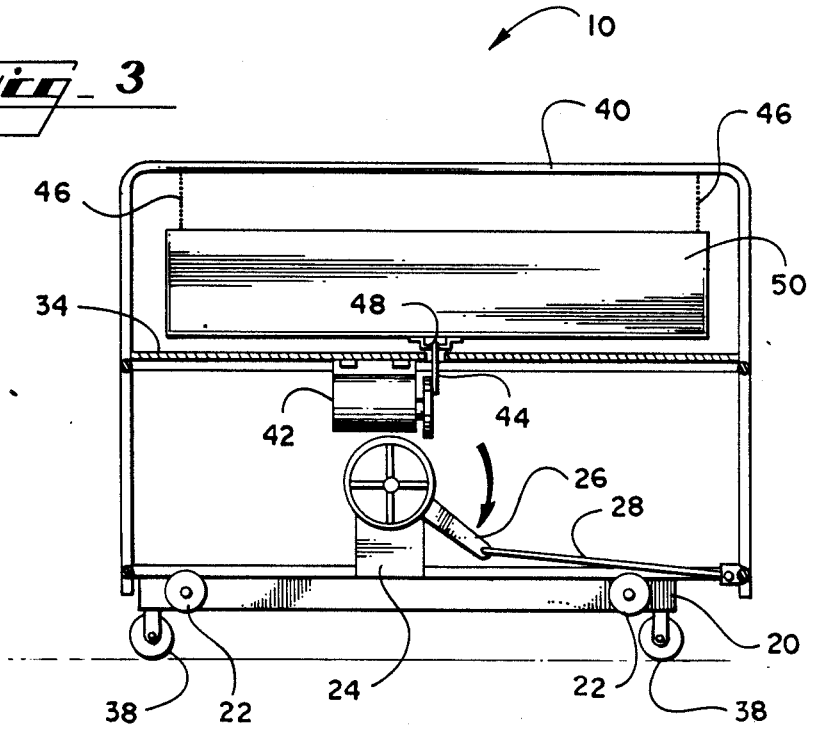
FIG. 3 is a front elevational view of the cradle of FIG. 1 with the frame covering removed.

Referring now also to FIGS. 3 and 4, the top-most portion of the frame 30 consists of a cradle support member 40. A cradle 50 is suspended from and oscillates from the cradle support member 40 through oscillatory suspension means 46. Oscillatory suspension means 46 may be a chain, arm, or other device which has one end attached to the cradle 50 and the other end attached to the cradle support member 40 so as to allow the cradle 50 to hang freely and be subject to oscillatory motion. Of course, any other mechanical means which would allow the cradle 50 to be supported and freely oscillate would also be suitable. For example, pivotally connecting the top ends of the cradle 50 directly to the cradle support member 40 so that the cradle 50 is free to oscillate about the pivot point. A mediate frame member 34 is positioned within the cradle frame 30 between the bottom-most and top-most portions of the cradle frame 30 to support a second motor 42. The second motor 42 has a crank arm 44 rotably attached to it. This second-motor crank arm 44, together with its motor 42, is positioned so that its rotational is perpendicular to the axis about which the cradle 50 will oscillate. The second-motor crank arm 44 and cradle 50 are positioned such that the second-motor crank arm 44 engages the cradle 50 through a part of the second-motor crank arm's 44 rotational arc. This contact imparts a motion and force to the cradle 50 causing it to oscillate. Although the second-motor crank arm 44 may impart motion to the cradle 50 by direct contact, in the embodiment illustrated, a cradle engagement member 48 is affixed to the bottom of the cradle 50 to receive contact from the crank arm 44. While the base 20 may rest upon the floor, wheels 38 may be affixed to allow the cradle 10 to be moved about.

The cradle 10 is subjected to two gentle motions; (1) a translational motion generated by the first motor 24 and (2) a swinging-type oscillatory motion generated by the second motor 42. This dual motion has been found to be extremely soothing to a baby lying in a cradle.

As should be apparent from the foregoing specification, the invention is susceptible of being modified with various alterations and modifications which may differ from those which have been described in the preceding specification and description. For example, but not by way of limitation, the cradle frame 30 is illustrated as being substantially rectangular, however, any geometric configuration which would facilitate adequate support and oscillatory motion would be suitable. Accordingly, the following claims are intended to cover all alterations and modifications which do not depart from the spirit and scope of the invention.

What is claimed is:

1. A cradle comprising:

a base having at least two parallel sides;

a plurality of roller members mounted along each said parallel side of said base;

a first motor mounted upon said base;

a first-motor crank member rotably driven by said first motor;

a connecting member having a first end and a second end, said first end pivotally connected to said crank member;

a cradle frame having a bottom-most portion and a top-most portion, said cradle frame having at least two support rods attached to said bottom-most portion, each said support rod corresponding to and slidably resting upon each said plurality of roller members mounted along said each said parallel side of said base, said second end of said connecting member pivotally connected to said cradle frame such that rotation of said crank member acts through said connecting member to impart reciprocating translational motion to said cradle frame, said top-most portion of said cradle frame consisting of a cradle support member, a mediate frame member disposed within said cradle frame;

a second motor mounted upon said mediate frame member; a second-motor crank member rotably driven by said second motor;

a cradle; and means for suspending said cradle from said cradle support member proximate said second-motor crank member such that said second-motor crank member will engage said cradle at a point of rotation during rotational motion of said second-motor crank member, imparting motion to said cradle causing said cradle to oscillate.

2. The invention of claim 1, said cradle having a cradle engagement member affixed thereto for engaging said second-motor crank member.

3. The invention of claim 2, wherein said cradle engagement member is affixed to a bottom surface of said cradle.

4. The invention of claim 1, said means for suspending said cradle from said upper support member comprises at least two lengths of chain, each said length of chain having an end affixed to said cradle support member and having another end affixed to said cradle.

* * * * *